US009912044B2

(12) United States Patent
Iijima et al.

(10) Patent No.: US 9,912,044 B2
(45) Date of Patent: Mar. 6, 2018

(54) ANTENNA BUILT-IN PORTABLE DEVICE

(71) Applicant: Seiko Epson Corporation, Shinjuku-ku (JP)

(72) Inventors: Yoshitaka Iijima, Oomachi (JP); Fumihiro Misawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 349 days.

(21) Appl. No.: 14/518,982

(22) Filed: Oct. 20, 2014

(65) Prior Publication Data

US 2015/0109172 A1 Apr. 23, 2015

(30) Foreign Application Priority Data

Oct. 22, 2013 (JP) ..... 2013-219442

(51) Int. Cl.
*H01Q 1/27* (2006.01)
*H01Q 1/24* (2006.01)
*G04R 60/06* (2013.01)

(52) U.S. Cl.
CPC ..... *H01Q 1/273* (2013.01); *G04R 60/06* (2013.01); *H01Q 1/241* (2013.01)

(58) Field of Classification Search
CPC ..... H01Q 1/273; H01Q 1/241; G04R 60/06
USPC ..... 343/718
See application file for complete search history.

(56) References Cited

U.S. PATENT DOCUMENTS 6,950,685 B2 9/2005 Barras et al.
7,167,134 B2 1/2007 Minami et al.
7,230,885 B2 6/2007 Sakurazawa et al.
7,443,353 B2 10/2008 Fujimoto et al.
2004/0137963 A1* 7/2004 Barras ..... G04G 9/08 455/575.1
2005/0047282 A1* 3/2005 Sakurazawa ..... G04R 60/12 368/281
2005/0116872 A1* 6/2005 Minami ..... G04R 60/06 343/788

(Continued)

FOREIGN PATENT DOCUMENTS

DE 20 2009 000651 U1 6/2009
EP 1 489 471 A1 12/2004

(Continued)

OTHER PUBLICATIONS

Extended European search report, dated May 8, 2015, of the corresponding European Application No. 14189494.9, 6 pages.

*Primary Examiner* — Dameon E Levi
*Assistant Examiner* — David Lotter
(74) *Attorney, Agent, or Firm* — Kilpatrick Townsend & Stockton LLP

(57) ABSTRACT

A wrist device, which is an antenna built-in portable device, includes an armor case including an opening at least on the front surface side, glass that closes the opening, a metal bezel attached to the front surface of the armor case and arranged around the glass, and an antenna arranged in a space on the inner side of the armor case. The antenna is a planar antenna, a maximum radiation direction of which is arranged to be directed toward the outer side of the bezel crossing the thickness direction of the armor case. The antenna is arranged in a position not overlapping the bezel in the maximum radiation direction of the antenna. At least a part of the antenna overlaps at least a part of the bezel in the thickness direction of the armor case.

10 Claims, 10 Drawing Sheets

(56) References Cited

U.S. PATENT DOCUMENTS

| | | | | |
|---|---|---|---|---|
| 2009/0059730 | A1* | 3/2009 | Lyons | G04G 21/04 368/69 |
| 2012/0320715 | A1 | 12/2012 | Maruyama | |

FOREIGN PATENT DOCUMENTS

| | | | |
|---|---|---|---|
| EP | 2 284 948 | A1 | 2/2011 |
| JP | 2002-290143 | A | 10/2002 |
| JP | 2003 152582 | A | 5/2003 |
| JP | 2005-098975 | A | 4/2005 |
| JP | 2005-159904 | A | 6/2005 |
| JP | 2006-272998 | A | 10/2006 |
| JP | 2007 266823 | A | 10/2007 |
| JP | 2008-203063 | A | 9/2008 |
| JP | 2010-216809 | A | 9/2010 |
| JP | 2013-002977 | A | 1/2013 |
| JP | 2013-002978 | A | 1/2013 |
| JP | 2013-061308 | A | 4/2013 |

* cited by examiner

ANTENNA BUILT-IN PORTABLE DEVICE

BACKGROUND

1. Technical Field

The present invention relates to an antenna built-in portable device incorporating an antenna.

2. Related Art

There has been known, as an antenna built-in portable device, an electronic watch capable of receiving a satellite signal transmitted from a GPS (Global Positioning System) satellite and measuring a present position (see, JP-A-2013-61308 (Patent Literature 1)).

The electronic watch includes a liquid-crystal panel section that displays information such as time and a present position and an antenna section that receives a satellite signal. The antenna section is configured by a patch antenna that receives a satellite signal, which is a circularly polarized radio wave. An armor case of the electronic watch is made of plastics (polycarbonate resin) in order to secure reception sensitivity in the antenna section.

In an inside space of the armor case, glass, the liquid-crystal panel section, a wiring board, the antenna section, a battery, and a back cover are arranged in this order from the front surface side of the electronic watch.

The antenna section is formed in a size same as the size of the liquid-crystal panel section and the wiring board. This prevents the liquid-crystal panel section from projecting in the shape of eaves from the antenna section and prevents deterioration in reception performance of the antenna section.

However, in the electronic watch described in Patent Literature 1, improvement of the feel of a material of the watch is limited because the armor case is made of plastics. For example, in a general wristwatch, it is possible to give a luxurious feel of metal to the surface design of the wristwatch by using a metal bezel as a bezel arranged around the glass.

However, if the metal bezel is arranged in the electronic watch disclosed in Patent Literature 1, the metal bezel projects in the shape of eves to the outer circumference side of the antenna section. Therefore, the reception performance of the antenna section is deteriorated.

Such a problem is not limited to the electronic watch and is common to antenna built-in portable devices such as portable devices that record moving routes of walking, running, cycling, mountain climbing, and the like.

SUMMARY

An advantage of some aspects of the invention is to provide an antenna built-in portable device that can improve the feel of a material and prevent deterioration in reception performance.

An aspect of the invention is directed to an antenna built-in portable device including: an armor case including an opening at least on a front surface side; a light-transmitting member that closes the opening; a metal bezel attached to the front surface of the armor case and arranged around the light-transmitting member; and an antenna arranged in a space on the inner side of the armor case. The antenna is a planar antenna, a maximum radiation direction of which is arranged to be directed toward the outer side of the bezel crossing the thickness direction of the armor case. The antenna is arranged in a position not overlapping the bezel in the maximum radiation direction of the antenna. At least a part of the antenna overlaps at least a part of the bezel in the thickness direction of the armor case.

In this aspect of the invention, the armor case may be a case, a case main body and a back cover of which are configured by separate bodies, or may be a case of a one-piece type configured as a single body. The antenna is configured by a planar antenna such as a micro strip antenna (a patch antenna) capable of receiving a satellite signal such as a GPS signal.

According to this aspect, the maximum radiation direction of the antenna is arranged to be directed toward the outer side of the bezel crossing the thickness direction of the armor case. Therefore, for example, when the antenna built-in portable device is worn on the arm of a user and used, the maximum radiation direction of the antenna often faces the sky direction. Therefore, the antenna can directly receive a satellite signal transmitted from a GPS satellite located in the maximum radiation direction and can improve reception sensitivity.

The antenna is arranged in the position not overlapping the metal bezel in the maximum radiation direction. Therefore, it is possible to prevent the satellite signal transmitted from the maximum radiation direction from being blocked by the metal bezel. Consequently, it is possible to improve the reception sensitivity in the antenna.

Further, since at least parts of the antenna and the bezel overlap in the thickness direction of the armor case, a radio wave made incident on the antenna from the thickness direction can be cut off by the metal bezel. Therefore, it is possible to suppress the reception of a satellite signal reflected on a building or the like and made incident on the antenna built-in portable device at an angle close to the horizontal. Therefore, it is possible to suppress occurrence of a multipath and improve accuracy of position information that can be acquired by the reception of the satellite signal.

Further, on the surface of the antenna built-in portable device, the metal bezel is arranged around the light-transmitting member made of glass, plastics, or the like. Therefore, a luxurious metallic ring can be arranged around the light-transmitting member. It is possible to improve design properties of the antenna built-in portable device.

In the antenna built-in portable device in the aspect of the invention described above, it is preferable that the antenna is arranged in a position where a first gap space, which is a minimum gap dimension in a direction orthogonal to the maximum radiation direction with respect to the bezel, is equal to or larger than a first dimension set in advance.

The first gap dimension means a gap dimension of portions closest to each other in the direction orthogonal to the maximum radiation direction between, for example, a ring-like bezel and a rectangular parallelepiped antenna. It is preferable to set the first dimension to be equal to or larger than, for example, 1 mm.

In this configuration, since the first gap dimension is set to be equal to or larger than the first dimension, it is possible to further suppress deterioration in reception sensitivity due to the influence of the metal bezel. It is possible to secure, for example, reception performance necessary for receiving a GPS signal.

In the antenna built-in portable device in the aspect of the invention described above, it is preferable that the antenna is arranged in a position where a third gap space, which is a minimum gap dimension in the thickness direction of the armor case with respect to the bezel, is equal to or smaller than a third dimension set in advance.

The third gap dimension means a gap dimension of portions closest to each other in the thickness direction of the armor case between, for example, a ring-like bezel and a rectangular parallelepiped antenna. It is preferable to usually set the third dimension to be larger than the first dimension and set to be equal to or smaller than, for example, 3.0 mm.

In this configuration, since the third gap dimension is set to be equal to or smaller than the third dimension, it is possible to prevent the gap between the metal bezel and the antenna from becoming markedly large. Therefore, it is possible to prevent deterioration in the effect of the bezel for blocking the reception of the satellite signal reflected on a building or the like. Therefore, it is possible to reduce the influence of the multipath.

In the antenna built-in portable device in the aspect of the invention described above, it is preferable that the antenna is configured by an antenna board and an antenna main body attached to the antenna board, the antenna main body is formed in a rectangular parallelepiped shape and includes an attachment surface attached to the antenna board, a radiation surface parallel to the attachment surface, and four side surfaces arranged between four sides of the attachment surface and four sides of the radiation surface, and one side among the four sides of the radiation surface is arranged in a position overlapping the bezel in the thickness direction of the armor case.

According to this configuration, it is possible to set the first gap dimension and the third gap dimension between the one side of the radiation surface and the bezel. According to this configuration, when the first gap dimension is set to be equal to or larger than the first dimension, it is possible to set the third gap dimension to a smallest dimension. Therefore, it is possible to easily attain both of the suppression effect for deterioration in the reception sensitivity and the reduction effect for the influence of the multipath and improve the reception performance.

In the antenna built-in portable device in the aspect of the invention described above, it is preferable that the maximum radiation direction of the antenna is an angle equal to or larger than 40 degrees and equal to or smaller than 50 degrees with respect to the thickness direction of the armor case.

According to this configuration, it is possible to balance a dimension in the plane direction occupied by the antenna in the armor case and a dimension in the thickness direction. Therefore, it is possible to prevent a situation in which one of the dimensions increases and the size and the thickness of the armor case increase. Therefore, it is possible to design the antenna built-in portable device in this configuration in a size appropriate for a wrist device worn on the wrist of a user.

In the antenna built-in portable device in the aspect of the invention described above, it is preferable that a display panel that displays information is arranged on the rear surface side of the light-transmitting member and, when an extended line extended along the maximum radiation direction from the outer circumferential edge of the bezel is defined, a portion opposed to the antenna at the outer circumferential edge of the display panel does not project further to the antenna side than the extended line.

As the display panel, a thin and low-power consumption display panel such as a liquid crystal panel or an organic EL panel (organic electroluminescence panel) can be used.

Such a display panel often includes a metal portion such as an ITO (Indium Tin Oxide) electrode. Therefore, if the portion opposed to the antenna is projected further to the antenna side than the defined extended line at the outer circumferential edge of the display panel, gap dimension of portions closest to each other in the direction orthogonal to the maximum radiation direction between the display panel and the antenna is smaller than the first gap dimension. In this case, it is likely that the reception performance in the antenna is deteriorated because of the influence of the metal portion of the display panel.

On the other hand, according to this configuration, it is possible to prevent the gap dimension between the display panel and the antenna from becoming smaller than the first gap dimension. Therefore, it is possible to reduce the influence of the metal portion of the display panel and secure the reception performance in the antenna.

BRIEF DESCRIPTION OF THE DRAWINGS

The invention will be described with reference to the accompanying drawings, wherein like numbers reference like elements.

DESCRIPTION OF EXEMPLARY EMBODIMENTS

A wrist device 1, which is an embodiment of an antenna built-in portable device according to the invention is explained below with reference to the drawings.

Figure 1:
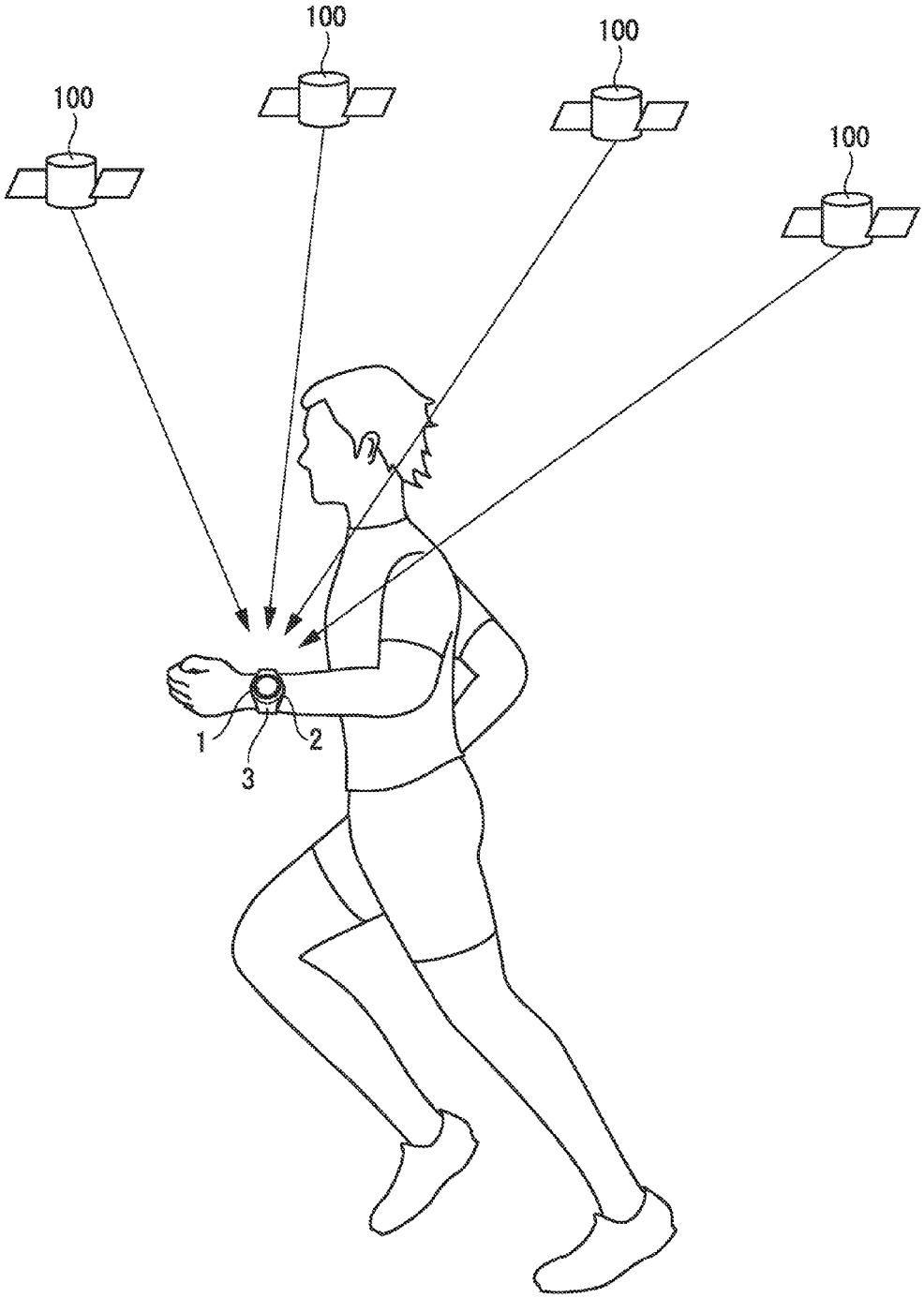
FIG. 1 is a diagram showing a state in which a wrist device in an embodiment of the invention is worn on the arm of a user.

As shown in FIG. 1, the wrist device 1 in this embodiment is a watch-type device worn on the wrist of a user. The wrist device 1 incorporates a GPS function for receiving, with a GPS receiver, satellite signals (GPS signals) transmitted from several GPS satellites 100 in the sky and learning the present position.

Consequently, the wrist device 1 can automatically measure, for example, a distance, speed, and a route of running according to position information and times of the GPS signals and can support exercise of the user.

Configuration of the Wrist Device

Figure 2:
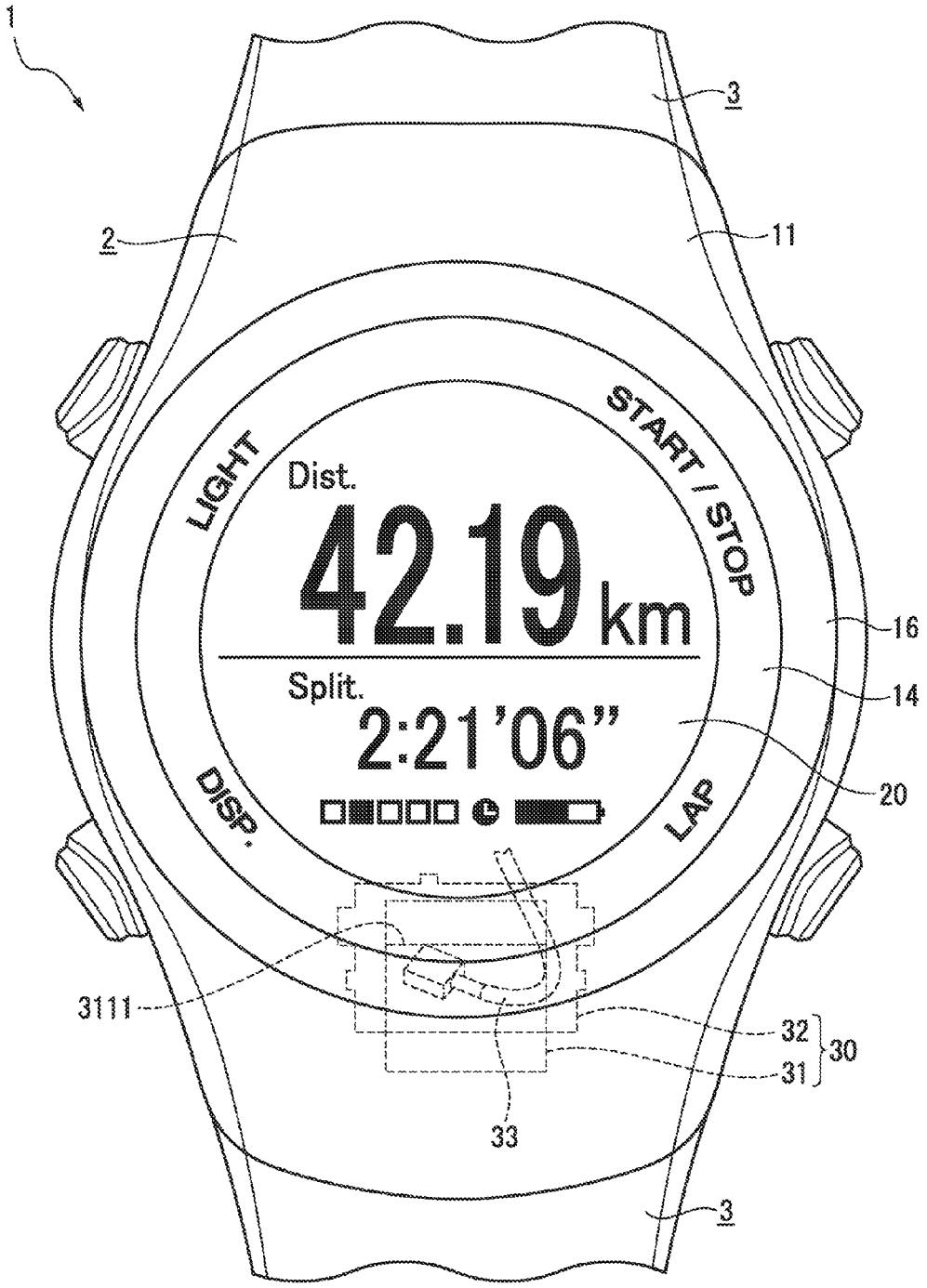
FIG. 2 is a front view showing the front surface side of the wrist device.
Figure 3:
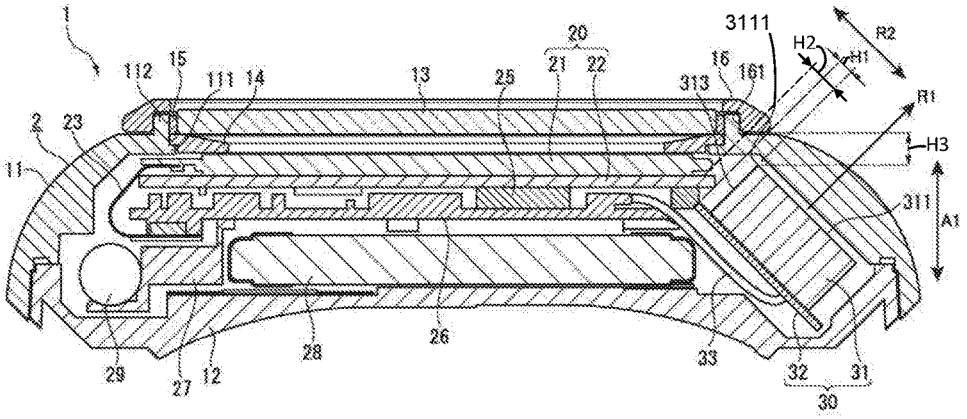
FIG. 3 is a sectional view of the wrist device.
Figure 4:
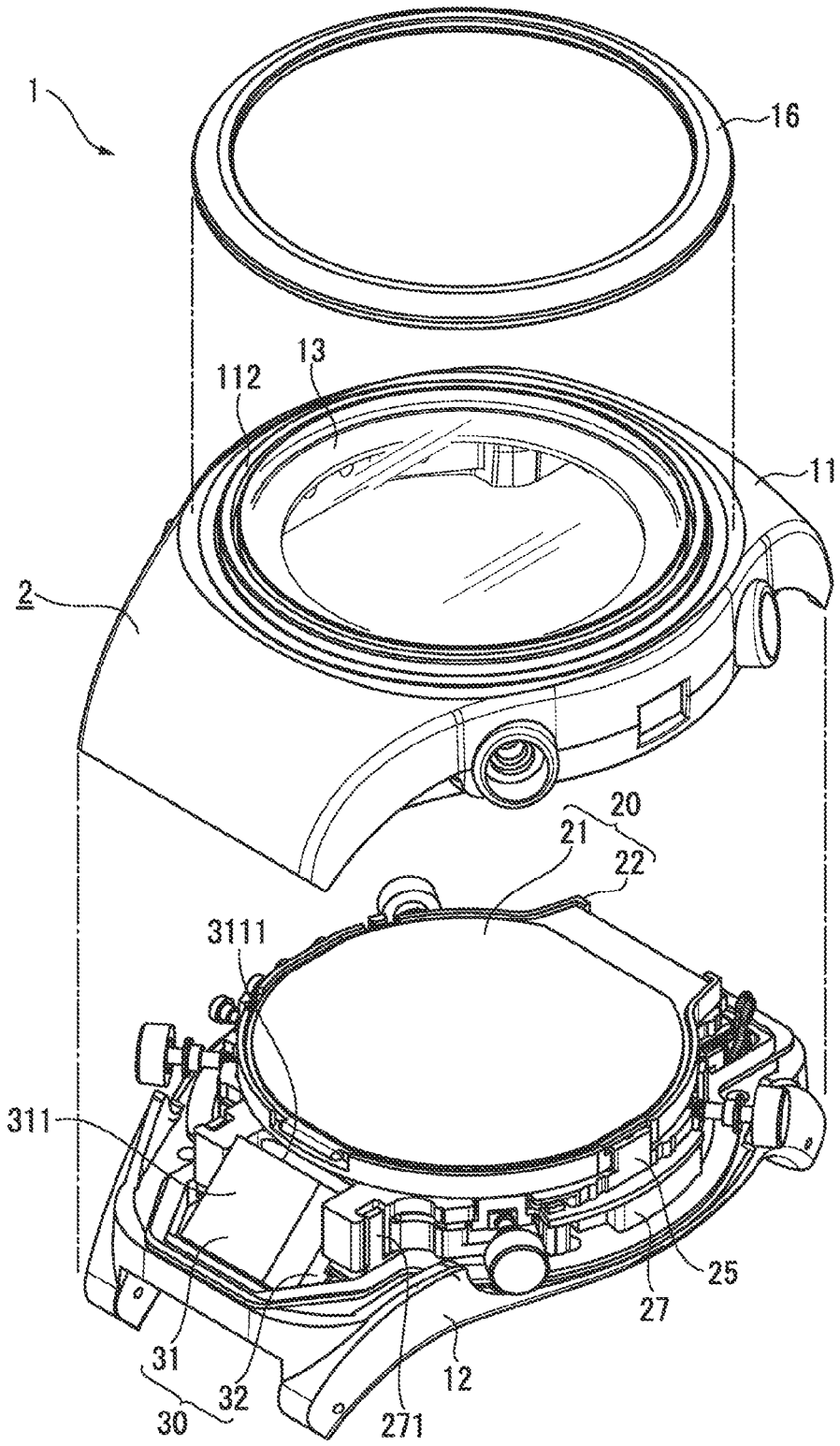
FIG. 4 is an exploded perspective view of the wrist device.

As shown in FIGS. 2 to 4 as well, the wrist device 1 includes an armor case 2 and a band 3. In the wrist device 1, a side for visually recognizing time and measurement data is represented as front surface side and a side worn on the arm is represented as rear surface side. When displayed information is seen on the front surface of the wrist device 1, an upper side is represented as 12 o'clock side and a lower side is represented as 6 o'clock side. The upper side and the lower side are set according to time display in a general analog watch. A direction connecting the rear surface side and the front surface side of the wrist device 1 (a direction of an arrow A1 shown in FIG. 3) is represented as thickness direction A1 of the wrist device 1.

Configuration of the Armor Case

The armor case 2 includes a case main body 11 and a back cover 12. The case main body 11 is made of plastics such as polycarbonate resin and is formed in a substantially cylindrical shape. In the case main body 11, the back cover 12 is attached to the rear surface side, which is the arm side on which the wrist device 1 is worn, and closes an opening on the rear surface side. The back cover 12 may be made of plastics like the case main body 11 or may be made of metal such as stainless steel.

As the armor case, an armor case of a one-piece type may be used in which the case main body 11 and the back cover 12 are integrally formed.

Glass (a windshield) 13, which is a light-transmitting member according to the invention, is attached to an opening on the front surface side of the case main body 11, that is, the armor case 2. In order to support the glass 13, as shown in FIG. 3, a protrusion section 111 projecting to the opening inner side is formed on the inner circumferential surface of the opening on the front surface side of the case main body 11. Further, on the front surface of the case main body 11, a circumferential ridge section 112 having an inner circumferential surface, which continues to the inner circumferential surface of the opening, and projecting toward the front surface side of the wrist device 1 is formed.

A support ring 14 for the glass 13 is locked to the front surface side of the protrusion section 111.

The glass 13 is placed on the front surface side of the support ring 14. A ring-like gasket 15 is arranged between the glass 13 and the ridge section 112.

Therefore, after the support ring 14 is arranged in the protrusion section 111 of the case main body 11, the glass 13 is press-fit in the ridge section 112 via the gasket 15, whereby the glass 13 is attached to the case main body 11. The light-transmitting member is not limited to the member made of the glass and may be a member made of plastics. The light-transmitting member only has to be a tabular member through which the user can visually recognize the rear surface side (a display section 20 explained below) from the front surface side thereof.

A bezel 16 is attached to the front surface side of the case main body 11. The bezel 16 is made of metal such as stainless steel or titanium and is formed in a ring shape. A groove section 161 to be press-fit in the outer circumferential surface of the ridge section 112 is formed on the rear surface of the bezel 16. The diameter of the inner circumferential surface of the groove section 161 is set to a dimension substantially the same as the diameter of the outer circumferential surface of the ridge section 112. Therefore, even when the ridge section 112 is about to be deformed to the outer circumference side because the glass 13 is press-fit in the ridge section 112, it is possible to prevent the deformation of the ridge section 112 by press-fitting to attach the metal bezel 16 to the ridge section 112 in advance. That is, the bezel 16 also has a function of reinforcing press-fitting and fixing of the glass 13 to the case main body 11.

It is possible to prevent, with the bezel 16, the ridge section 112 from being deformed to the outer circumference side. Therefore, the gasket 15 is arranged between the glass 13 and the ridge section 112 without a gap. As a result, it is possible to secure a necessary waterproof property.

Internal Structure of the Wrist Device

Figure 5:
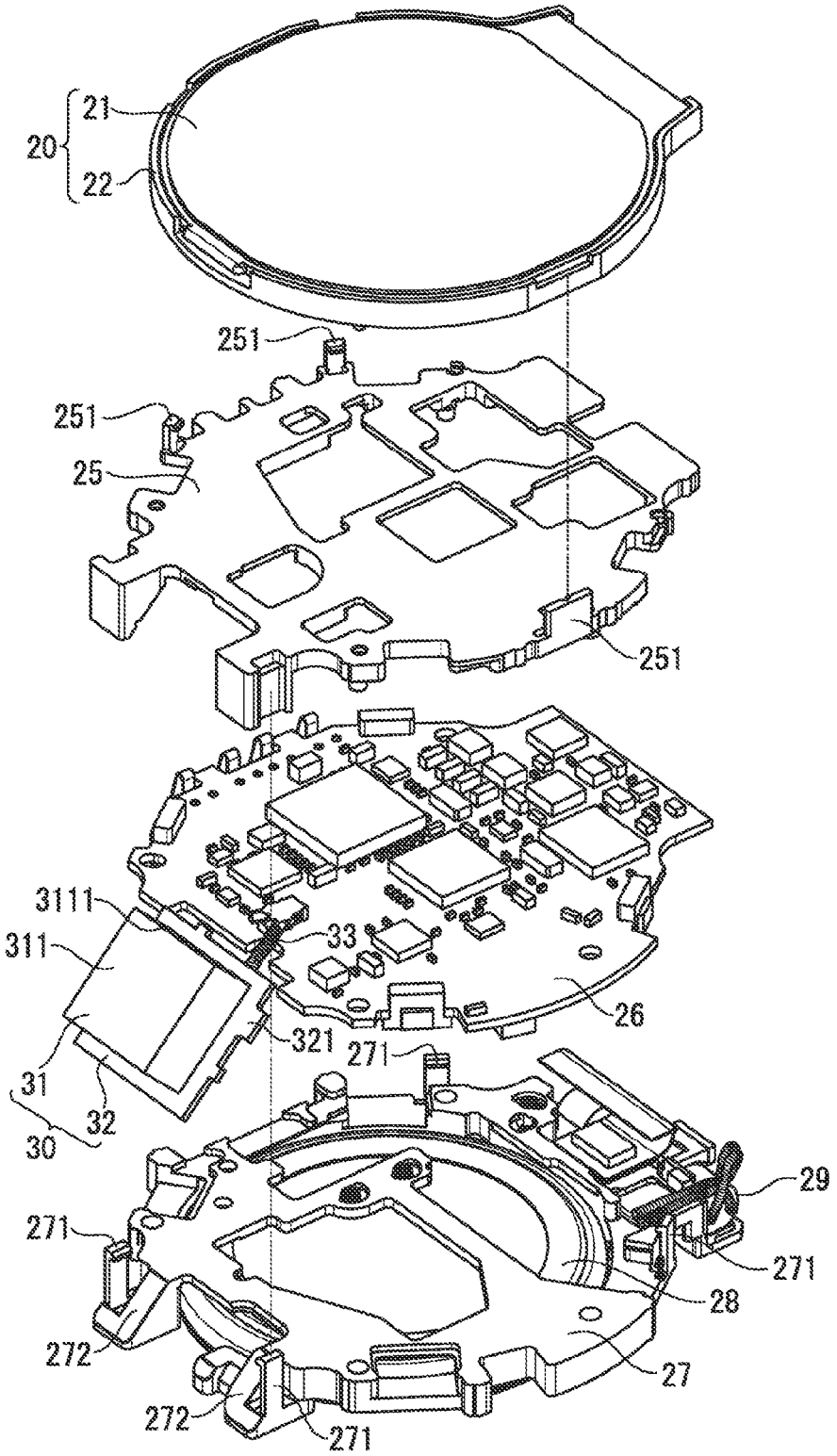
FIG. 5 is an exploded perspective view showing a display section, a spacer, a circuit board, a circuit case, and an antenna of the wrist device.

In the internal space between the case main body 11 and the back cover 12 (the internal space of the armor case 2), as shown in FIGS. 4 and 5, the display section 20, a spacer 25, a circuit board 26, and a circuit case 27 are arranged in order from the glass 13 side (the front surface side) to the back cover 12 side (the rear surface side). In the internal space of the armor case 2, an antenna 30 is arranged laterally to the display section 20, the circuit board 26, and the circuit case 27. As shown in FIG. 2, the antenna 30 is arranged on one band 3 side (the 6 o'clock side in the watch) with respect to the display section 20 located in the surface center of the wrist device 1.

The display section 20 includes a liquid crystal panel 21 with a backlight and a panel frame 22 that holds the liquid crystal panel 21. The liquid crystal panel 21 is connected to the circuit board 26 via a flexible board 23. The panel frame 22 is made of a nonconductive member such as plastics.

The spacer 25 is made of a nonconductive member such as plastics and arranged between the panel frame 22 and the circuit board 26. A plurality of hooks 251 are formed to project on the surface (the surface on the glass 13 side) of the spacer 25. The panel frame 22 of the display section 20 is held by the hooks 251.

The circuit board 26 is mounted with various ICs and the like for controlling the display of the display section 20 and processing a satellite signal received by the antenna 30.

The circuit case 27 is made of a nonconductive member such as plastics and holds a secondary battery 28, a vibration motor 29, and the like. A plurality of hooks 271 is formed to project on the upper surface of the circuit case 27. In a state in which the circuit board 26 is held between the spacer 25 and the circuit case 27, the hooks 271 are engaged with the spacer 25 to integrate the spacer 25, the circuit board 26, and the circuit case 27.

Holding Structure for the Antenna

Figure 6:
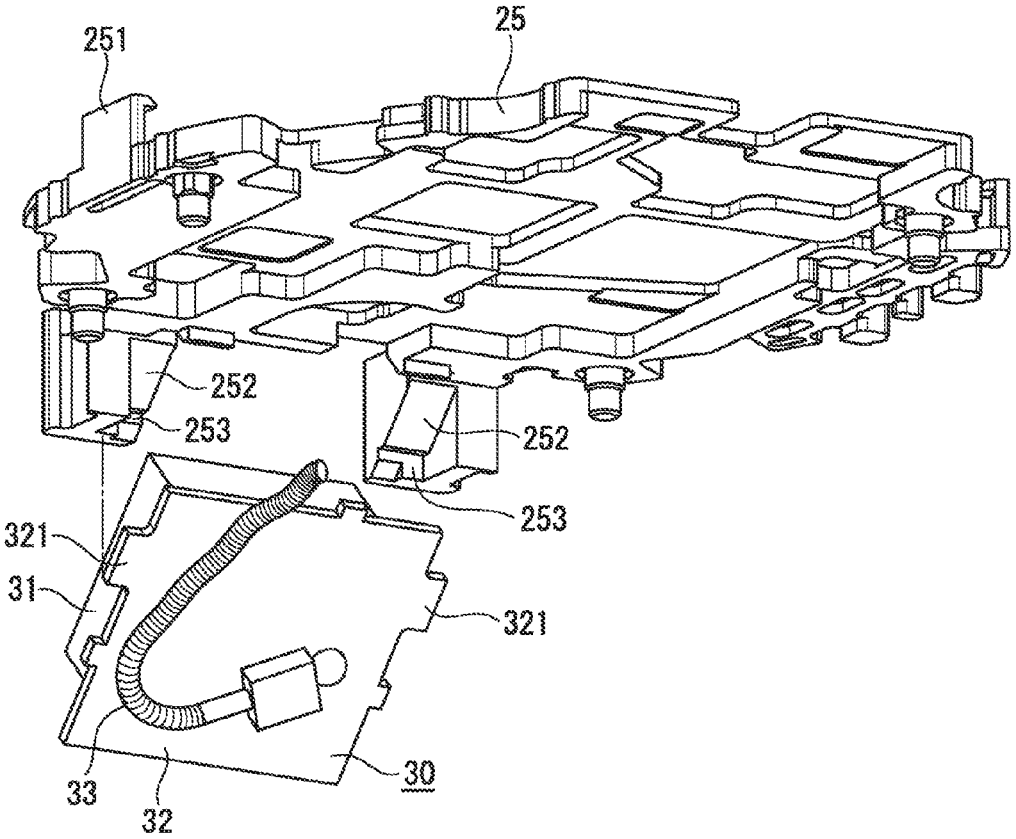
FIG. 6 is an exploded perspective view showing the spacer and the antenna of the wrist device.

As shown in FIGS. 5 and 6, on opposed surfaces of the spacer 25 and the circuit case 27, inclined surfaces 252 and 272 inclined in a range of an angle equal to or larger than 40 degrees and equal to or smaller than 50 degrees with respect to the thickness direction of the wrist device 1 are formed. In this embodiment, the angle of the inclined surfaces 252 and 272 is set to 45 degrees. When the spacer 25 and the circuit case 27 are integrated, an antenna board 32 of the antenna 30 is held between the inclined surfaces 252 and 272 to hold the antenna 30.

In particular, on both side surfaces of the antenna board 32, a protrusion 321 projecting sideways is formed. A wall section 253, with which the end face on the inclining direction lower side of the protrusion 321 comes into contact, is formed in the spacer 25. Therefore, the position of the antenna 30 in the direction along the inclined surfaces 252 and 272 is regulated. Therefore, the antenna 30 is held in a predetermined position (a position where a first gap dimension H1 and a third gap dimension H3 explained below are set values) with respect to the case main body 11 by the spacer 25 and the circuit case 27.

Configuration of the Antenna

The antenna 30 includes an antenna main body 31 configured by an antenna chip for GPS and the antenna board 32 on which the antenna main body 31 is mounted. Therefore, the antenna 30 is configured by an antenna module that includes the antenna main body 31 and the antenna board 32 and receives GPS signals transmitted from the GPS satellites 100. The antenna board 32 is connected to the circuit board 26 via a coaxial cable 33.

The antenna main body 31 is configured by a micro strip antenna (a patch antenna), which is a rectangular parallelepiped planar antenna. In the antenna main body 31, a ground electrode, a dielectric layer, and a radiation electrode not shown in the figure are laminated in this order from the antenna board 32 side toward the case main body 11. Therefore, the antenna 30 has directivity. As shown in FIG. 3, a maximum radiation direction R1 of the antenna 30 is a direction orthogonal to the plane of the antenna board 32, that is, the surface of the radiation electrode.

Arrangement Position of the Antenna

As explained above, the antenna 30 is positioned by the spacer 25 and the circuit case 27. Therefore, the antenna 30 is arranged in the predetermined position with respect to the case main body 11.

That is, as shown in FIGS. 2 and 3, in a plan view from the glass 13 side of the wrist device 1 (the front surface side of the wrist device 1), the antenna main body 31 is arranged in a position not overlapping the liquid crystal panel 21 and overlapping the bezel 16. That is, the antenna main body 31 is arranged in a position not overlapping the liquid crystal panel 21 (the outer circumference side of the liquid crystal panel 21) in the thickness direction A1 of the wrist device 1. That is, the antenna 30 is arranged to shift in the 6 o'clock direction of the 12 o'clock direction and the 6 o'clock direction, in which the band 3 is connected, with respect to the liquid crystal panel 21 of the wrist device 1.

At least a part of the antenna main body 31 overlaps a part of the bezel 16 (a part on the 6 o'clock side of the wrist device 1) in the thickness direction A1. Specifically, in the rectangular parallelepiped antenna main body 31, one side 3111 among four sides of a surface (a radiation surface 311) on the opposite side of a surface (an attachment surface) opposed to the antenna board 32 is arranged in a position overlapping the bezel 16. That is, the one side 3111 is a crossing line of a side surface 313, which is opposed to the glass 13 in the antenna main body 31, and the radiation surface 311.

The radiation surface 311 of the antenna main body 31 is inclined at an angle equal to or larger than 40 degrees and equal to or smaller than 50 degrees, specifically, an angle of 45 degrees with respect to the thickness direction A1. Therefore, the maximum radiation direction R1 is also set to the angle of 45 degrees (the angle equal to or larger than 40 degrees and equal to or smaller than 50 degrees) with respect to the thickness direction A1.

The one side 3111 nearest to the glass 13 side in the radiation surface 311 of the antenna main body 31 overlaps the bezel 16 in the thickness direction A1. Therefore, the bezel 16 and the antenna main body 31 overlap in the plan view from the front surface side of the wrist device 1.

Setting of the First Gap Dimension H1

The antenna main body 31 is arranged in a position not overlapping the bezel 16 in the maximum radiation direction R1. That is, the first gap dimension H1 shown in FIG. 3 between the antenna main body 31 and the bezel 16 is set to be equal to or larger than a first dimension. The first gap dimension H1 is a minimum gap dimension between the antenna main body 31 and the bezel 16 in a direction R2 orthogonal to the maximum radiation direction R1. Specifically, a gap dimension in the direction R2 between the one side 3111 of the antenna main body 31 and the outer circumferential edge of the bezel 16 is the first gap dimension H1.

The first dimension is set to 1 mm. The first dimension is verified by an experimental example explained below.

Setting of the Third Gap Dimension H3

The antenna main body 31 is arranged, with respect to the bezel 16, in a position where the third gap dimension H3, which is the minimum gap dimension in the thickness direction A1, is equal to or smaller than a third dimension. The third dimension is equal to or larger than the first dimension. In this embodiment, the third dimension is set to 3.0 mm. That is, the third gap dimension H3 is set, for example, in a range of a dimension equal to or larger than 1.3 mm and equal to or smaller than 3.0 mm and is set to, for example, 2.5 mm.

In this embodiment, since the one side 3111 of the antenna main body 31 is nearest to the bezel 16, the third gap dimension H3 is a gap dimension in the thickness direction A1 between the one side 3111 and the rear surface (the surface on the back cover 12 side) of the bezel 16.

Further, a second gap space, with a second gap dimension H2 in the direction R2 between the antenna main body 31 and the liquid crystal panel 21 is set to be equal to or larger than the first gap dimension H1. That is, when an extended line passing at the outer circumferential edge of the bezel 16 and extended in a direction along the maximum radiation direction R1 is set, the bezel 16 is configured not to project further to the antenna main body 31 side than the extended line. Therefore, like the metal bezel 16, a metal portion of an ITO (Indium Tin Oxide) electrode or the like of the liquid crystal panel 21 is apart from the antenna main body 31 by the first gap dimension H1 or more in the direction R2 orthogonal to the maximum radiation direction R1.

Action and Effects of this Embodiment

As shown in FIG. 1, the wrist device 1 having the configuration explained above is worn on the arm of the user and used like a wristwatch. When the wrist device 1 is worn on the arm of the user and used, the antenna 30 is arranged on the 6 o'clock side of the wrist device 1. The maximum radiation direction R1 is set in a direction inclining with respect to the thickness direction A1 (crossing the thickness direction A1) and a direction toward the outer side of the bezel 16.

Therefore, during running or walking, the maximum radiation direction R1 of the antenna 30 often faces the sky direction. Therefore, the antenna 30 can directly receive a satellite signal transmitted from the GPS satellite 100 located in the maximum radiation direction R1 and improve reception sensitivity.

The first gap dimension H1 between the antenna main body 31 and the bezel 16 in the direction R2 orthogonal to the maximum radiation direction R1 is set to be equal to or larger than the first dimension (1 mm). The antenna main body 31 and the bezel 16 are arranged in positions not overlapping each other in the maximum radiation direction R1. Therefore, a satellite signal transmitted from the maximum radiation direction R1 and received by the antenna main body 31 is not blocked by the metal bezel 16. It is possible to improve the reception sensitivity in the antenna main body 31.

In particular, by setting the first gap dimension H1 to be equal to or larger than 1 mm, it is possible to secure the reception performance of the antenna 30 as shown in FIGS. 7 to 10. The abscissa in FIGS. 7 to 10 indicates the first gap dimension H1 between the antenna 30 and the metal bezel 16. Therefore, a minus value of the first gap dimension H1 indicates that a part of the antenna main body 31 and a part of the bezel 16 overlap each other in the maximum radiation direction R1.

Figure 7:
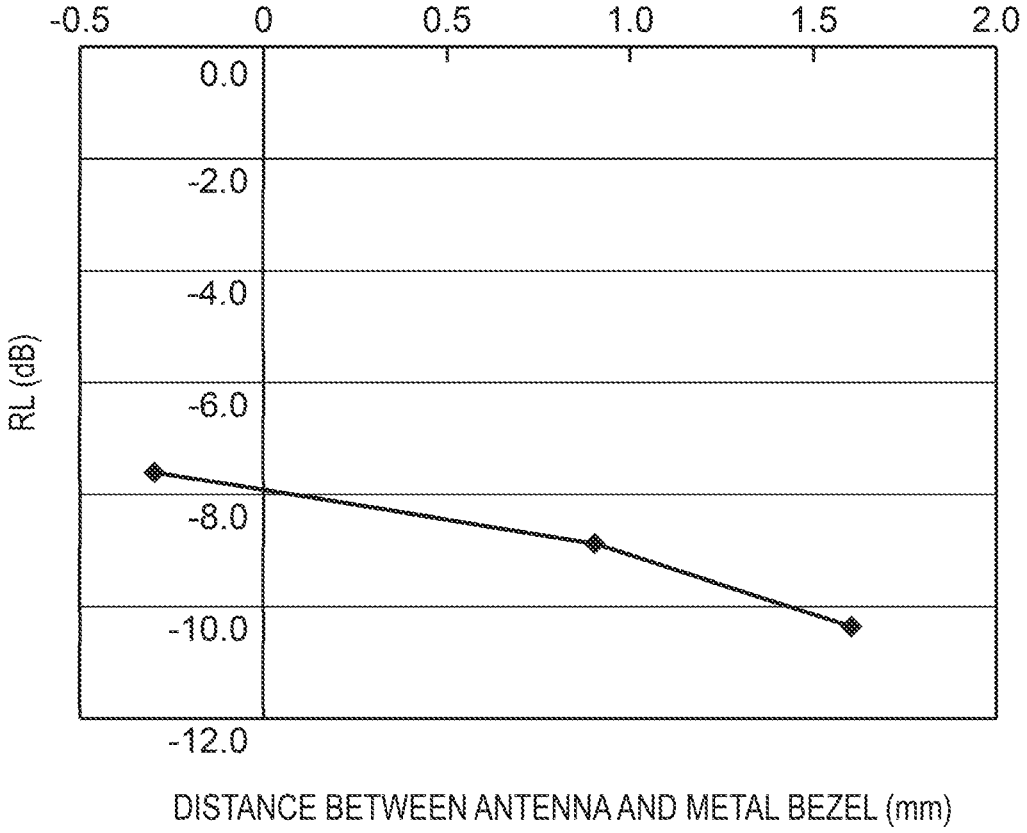
FIG. 7 is a graph showing a relation between a first gap dimension H1 between an antenna main body and a bezel and a return loss.
Figure 8:
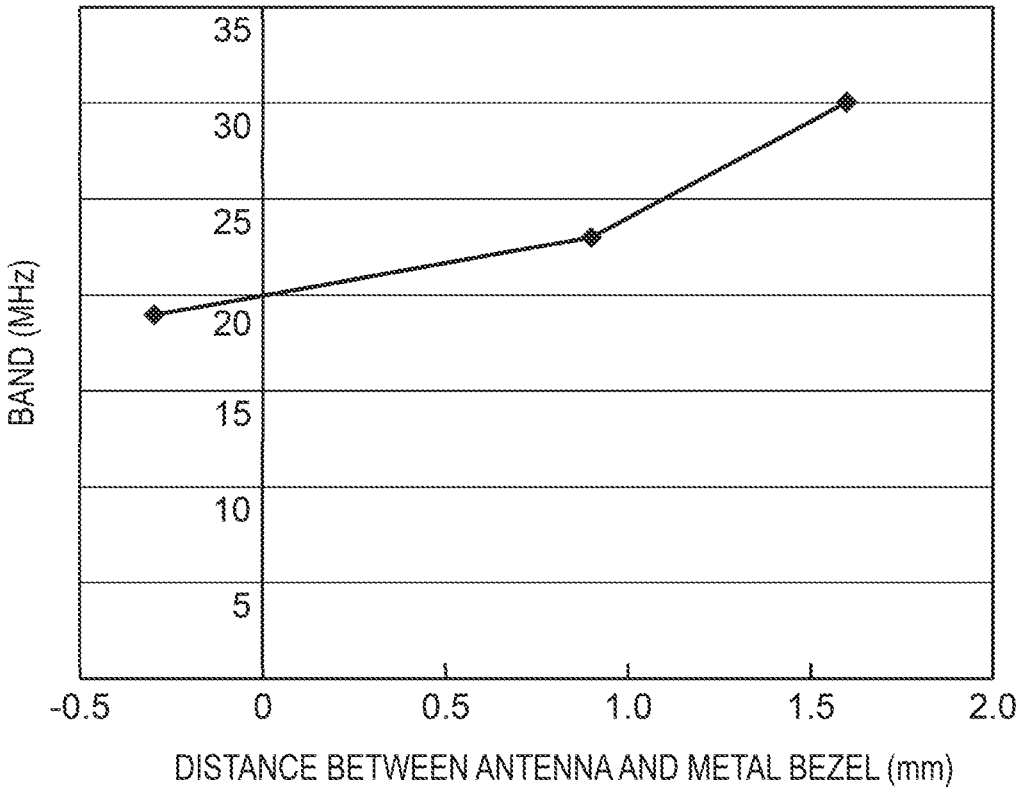
FIG. 8 is a graph showing a relation between the first gap dimension H1 and a frequency band.
Figure 9:
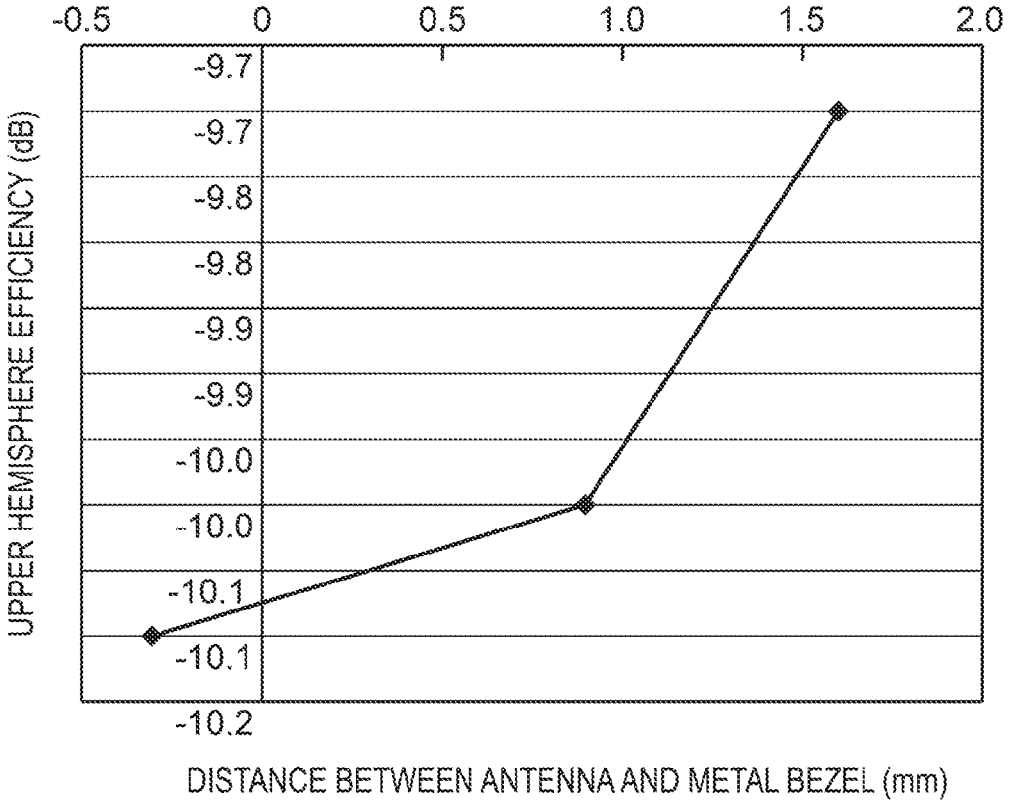
FIG. 9 is a graph showing a relation between the first gap dimension H1 and upper hemisphere efficiency.
Figure 10:
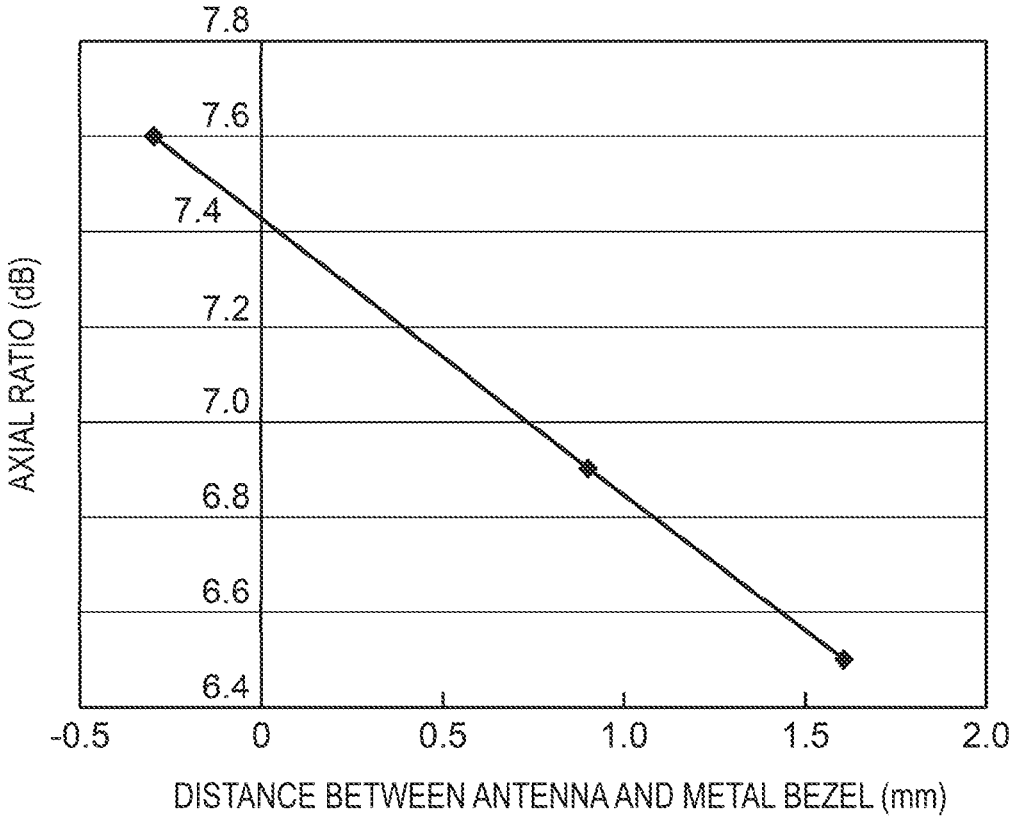
FIG. 10 is a graph showing a relation between the first gap dimension H1 and an axial ratio of a circularly polarized wave.

FIG. 7 shows a return loss that indicates a loss of the antenna 30. A lower value indicates better performance. FIG. 8 shows a frequency band in which the return loss is equal to or smaller than −10 dB. Whereas the frequency of a radio wave used in a GPS signal is 1.57 GHz, there is no practical problem if the frequency band is equal to or higher than 5 MHz. FIG. 9 shows upper hemisphere efficiency and shows an average of sensitivity of a hemisphere section in a satellite direction when the wrist device 1 is worn on the arm. FIG. 10 shows an axial ratio of a circularly polarized wave.

As shown in FIGS. 7 to 10, concerning all characteristics, it has been confirmed that sensitivity deterioration is low and sufficient performance can be secured if the first gap dimension H1 between the metal bezel 16 and the antenna 30 (the antenna main body 31) is equal to or larger than 1 mm.

Further, the antenna main body 31 is arranged the first gap dimension H1 or more apart from not only the bezel 16 but also the liquid crystal panel 21. Therefore, it is possible to prevent the metal ITO electrode or the like of the liquid crystal panel 21 from affecting the reception sensitivity in the antenna 30.

Therefore, it is possible to secure reception sensitivity necessary for the wrist device 1 that receives GPS signals and acquire position information.

Parts of the antenna main body 31 and the bezel 16 overlap in the thickness direction A1. Therefore, it is possible to block, with the metal bezel 16, a radio wave made incident on the wrist device 1 from the thickness direction A1 and prevent reception in the antenna main body 31. That is, when the user is performing running or the like, satellite signals transmitted from the GPS satellites 100 in the sky are transmitted from the maximum radial direction R1. Therefore, the satellite signals can be directly received by the antenna main body 31.

On the other hand, a part of the satellite signals transmitted from the GPS satellites 100 are sometimes reflected on a building or the like and made incident on the wrist device 1 at an angle near the horizontal. When both of the satellite signals reflected on the building or the like and the satellite signals directly transmitted from the GPS satellites 100 are received by the antenna 30 and a multipath occurs, a shift of time of the received satellite signals occur. Therefore, it is likely that correct time information and position information cannot be acquired.

On the other hand, in this embodiment, since the bezel 16 is made of metal and parts of the bezel 16 and the antenna main body 31 overlap each other in the thickness direction A1, reflected waves of the satellite signals can be blocked by the bezel 16. Therefore, it is possible to suppress occurrence of the multipath and improve accuracy of position information that can be acquired by the reception of the satellite signals.

On the front surface of the wrist device 1, the metal bezel 16 is arranged around the glass 13. Therefore, on the front (the front surface) of the wrist device 1, which is considered to be the face of the wrist device 1, a luxurious metallic ring can be arranged around an information display region formed by the display section 20. It is possible to improve design properties of the wrist device 1.

Moreover, the bezel 16 can reinforce the holding of the glass 13 by the ridge section 112 when the glass 13 is press-fit and can improve waterproof performance by the gasket 15.

Further, since the holding of the glass 13 can be reinforced by the bezel 16, it is unnecessary to form the ridge section 112 thick. Therefore, it is possible to improve design properties, reduce the case main body 11 in size, and reduce manufacturing costs.

The antenna 30 is held by the spacer 25 and the circuit case 27. In particular, the antenna 30 can be positioned by bringing the protrusion 321 of the antenna board 32 into contact with the wall section 253 formed in the spacer 25. Therefore, it is possible to accurately arrange the antenna 30 with respect to the case main body 11 in a position where the first gap dimension H1 and the third gap dimension H3 can be secured.

Further, the holding and the position setting of the antenna 30 are mainly performed by the spacer 25. Therefore, by preparing the spacer 25 corresponding to the size of the armor case 2, it is possible to position the antenna 30 in the predetermined position even with respect to the armor case 2 having a different size and hold the antenna 30. Consequently, it is possible to standardize the components other than the case main body 11, the back cover 12, and the spacer 25 and reduce costs.

The third gap dimension H3 in the thickness direction A1 between the antenna main body 31 of the antenna 30 and the bezel 16 is suppressed to be equal to or smaller than 3.0 mm. Therefore, it is possible to prevent the thickness dimension of the wrist device 1 from increasing.

Further, by suppressing the third gap dimension H3 to be equal to or smaller than 3.0 mm, it is possible to prevent deterioration in a radio wave blocking effect by the metal bezel 16. That is, when the third gap dimension H3 increases and the gap between the bezel 16 and the antenna main body 31 increases, it is more highly likely that a radio wave passing the side of the bezel 16 reaches the antenna main body 31 via the gap portion. Therefore, the multipath is likely to occur. On the other hand, by setting the antenna main body 31 near the metal bezel 16, it is possible to secure a reflected wave blocking effect by the bezel 16. A lower limit value of the third gap dimension H3 is specified by the first gap dimension H1. Therefore, the first gap dimension H1 only has to be set to a value that can secure the first dimension or more (e.g., 1 mm or more).

The maximum radiation direction R1 of the antenna 30 is inclined in the direction in the range of the angle equal to or larger than 40 degrees and equal to or smaller than 50 degrees, specifically, the direction of 45 degrees with respect to the thickness direction A1. Therefore, in the armor case 2, it is possible to appropriately set a balance between a dimension in the thickness direction A1 of a space necessary for housing the antenna 30 and a dimension in the plane direction orthogonal to the thickness direction A1. It is possible to set the plane size and the thickness dimension of the armor case 2 to appropriate sizes.

For example, when the inclination angle of the antenna 30 with respect to the thickness direction A1 is reduced and the maximum radiation direction R1 is brought close to the direction orthogonal to the thickness direction A1, the dimension in the thickness direction A1 of the armor case 2 in which the antenna 30 is arranged increases. It is difficult to reduce the armor case 2 in thickness. On the other hand, when the inclination angle of the antenna 30 with respect to the thickness direction A1 is increased and the maximum radiation direction R1 is brought close to the direction along the thickness direction A1, the plane dimension of the armor case 2 in which the antenna 30 is arranged increases. The maximum radiation direction R1 is close to the horizontal direction when the user wears the wrist device 1 on the arm and performs running or the like. Therefore, the reception sensitivity of satellite signals is deteriorated.

On the other hand, as in this embodiment, if the antenna 30 is set in the range of 40 to 50 degrees with respect to the thickness direction A1, it is possible to keep the armor case 2 within an appropriate size and secure the reception sensitivity of satellite signals.

Modifications

The invention is not limited to the embodiment. Various modifications are possible within the scope of the gist of the invention.

The light-transmitting member (the glass 13), the display section 20, and the bezel 16 of the wrist device 1 are not limited to the circular shape and may have other shapes such as an elliptical shape and a rectangular shape. The armor case 2 only has to be designed according to the shapes.

The antenna 30 is not limited to the configuration in the embodiment. For example, the antenna main body 31 is not limited to the configuration in which the ground electrode, the dielectric layer, and the radiation electrode are directly stuck together and laminated. The antenna main body 31 may have a configuration in which other substrates or the like are inserted among these layers.

The arrangement position of the antenna 30 in the wrist device 1 is not limited to the 6 o'clock side of the display section 20 and may be the 12 o'clock side in the armor case 2. In this case, the armor case 2 of the wrist device 1 can be arranged on the inner side of the wrist.

A fixing structure for the antenna 30 is not limited to the structure in which the antenna 30 is held by the spacer 25 and the circuit case 27 in the embodiment. Other fixing structures may be used in which, for example, the antenna board 32 is screwed by the circuit case 27 and the spacer 25. However, the configuration in the embodiment has an advantage that it is possible to improve assembleability.

The first gap dimension H1 is not limited to the dimension equal to or larger than 1 mm. The first gap dimension H1 only has to be at least equal to or larger than 0 mm and may be any dimension as long as the antenna main body 31 does not overlap the bezel 16 in the maximum radiation direction R1. However, as shown in FIGS. 7 to 10, if the first gap dimension H1 is set to be equal to or larger than 1 mm, there is an advantage that it is possible to improve the reception performance.

The wrist device is not limited to the embodiment and may be an electronic watch and the like including the antenna 30. The antenna built-in portable device is not limited to the wrist device worn on the arm and can also be applied to a pocket watch, a portable electronic device, and the like.

The display panel of the display section 20 is not limited to the liquid crystal panel 21 and only has to be small and thin displays that can be built in the wrist device 1 such as an organic EL panel (organic electroluminescence panel) and an EPD (Electrophoretic Display).

The entire disclosure of Japanese Patent Application No. 2013-219442, filed Oct. 22, 2013 is expressly incorporated by reference herein.

What is claimed is:

1. An antenna built-in portable device comprising:

an armor case including an opening at least on a front surface side;

a light-transmitting member that closes the opening;

a metal bezel attached to the front surface of the armor case and arranged around the light-transmitting member;

an antenna arranged in a space on an inner side of the armor case, wherein the antenna is a planar antenna, a maximum radiation direction of which is arranged to be directed in a direction away from the bezel crossing a thickness direction of the armor case, the antenna and the bezel define a first gap space in a direction orthogonal to the maximum radiation direction of the antenna so that the bezel and the antenna do not overlap in the direction orthogonal to the maximum radiation direction of the antenna, and the antenna is arranged in a position not overlapping the bezel in the maximum radiation direction of the antenna, and at least a part of the antenna overlaps at least a part of the bezel in a plan view of the bezel; and a liquid crystal panel that displays information arranged on a rear surface side of the light-transmitting member, wherein the liquid crystal panel and the antenna define a second gap space in the direction orthogonal to the maximum radiation direction of the antenna, and wherein the second gap space is greater than or equal to the first gap space.

2. The antenna built-in portable device according to claim 1, wherein the antenna and the bezel define a third gap space between the bezel and the antenna in the thickness direction of the armor case, and wherein the third gap space is greater than the first gap space.

3. The antenna built-in portable device according to claim 1, wherein the antenna is configured by an antenna board and an antenna main body attached to the antenna board, the antenna main body is formed in a rectangular parallelepiped shape and includes an attachment surface attached to the antenna board, a radiation surface parallel to the attachment surface, and four side surfaces arranged between four sides of the attachment surface and four sides of the radiation surface, and one side among the four sides of the radiation surface is arranged in a position overlapping the bezel in the thickness direction of the armor case.

4. The antenna built-in portable device according to claim 1, wherein the maximum radiation direction of the antenna is an angle equal to or larger than 40 degrees and equal to or smaller than 50 degrees with respect to the thickness direction of the armor case.

5. The antenna built-in portable device according to claim 1, wherein the antenna built-in portable device is a wristwatch type device including a band fixed to the armor case.

6. The antenna built-in portable device according to claim 1, wherein when the first gap space is H1, H1 satisfies the following relation, $0<H1\leq1.5$ mm.

7. The antenna built-in portable device according to claim 6, wherein H1 satisfies the following relation, $1.0\ \text{mm}\leq H1\leq1.5$ mm.

8. The antenna built-in portable device according to claim 2, wherein when the third gap space is H3, H3 satisfies the following relation, $H3\leq3.0$ mm.

9. The antenna built-in portable device according to claim 1, comprising a circuit case configured to couple to a circuit board, wherein the spacer comprises at least one inclined surface that supports and angles the antenna main body.

10. The antenna built-in portable device according to claim 9, wherein the antenna main body is angled between 40-50 degrees with respect to the thickness direction of the armor case.

* * * * *